United States Patent [19]

Kaufhold

[11] 4,024,958

[45] May 24, 1977

[54] COUPLER KNUCKLE CONTOUR

[75] Inventor: Horst Thomas Kaufhold, Chicago, Ill.

[73] Assignee: Amsted Industries Incorporated, Chicago, Ill.

[22] Filed: Feb. 17, 1976

[21] Appl. No.: 658,472

[52] U.S. Cl. ..... 213/152; 213/151

[51] Int. Cl.[2] ..... B61G 3/04

[58] Field of Search ..... 213/109, 151, 152, 154

[56] References Cited

UNITED STATES PATENTS

| | | | |
|---|---|---|---|
| 2,562,504 | 7/1951 | Metzger | 213/151 |
| 3,670,901 | 6/1972 | Metzger | 213/151 |
| 3,779,397 | 12/1973 | DePenti | 213/109 X |

*Primary Examiner*—Stanley H. Tollberg
*Assistant Examiner*—Fred A. Silverberg
*Attorney, Agent, or Firm*—Fred P. Kostka

[57] ABSTRACT

The front face of an Association of American Railroads (A.A.R.) type E coupler knuckle, forward of the knuckle pivot center when the knuckle is in closed position, is formed of intersecting surfaces, one of which slopes rearwardly at an angle of approximately 12° with the other surface and intersects the other surface at a location between the longitudinal axis of the coupler and a line parallel to that axis through the pivot pin hole, thereby ensuring complete closing and locking of the mating knuckles of couplers approaching under maximum angling conditions.

4 Claims, 3 Drawing Figures

COUPLER KNUCKLE CONTOUR

The present invention relates to A.A.R. type E railway car couplers and particularly to an improved knuckle contour which ensures complete coupling of horizontally angled couplers.

When couplers approach for coupling under conditions of maximum horizontal angling, closure of the engaging knuckles must be completed by contact of the front face of each knuckle with the front buffing face of the adjacent coupler. In some instances, particularly under maximum horizontal angling conditions, the prior art knuckles failed to pivot to a completely closed position so as to permit the coupler lock to drop into locked position to complete the coupler operation. The reason for this failure to completely close was that contact of the closing knuckle against the front face of the opposing coupler was made by the curved knuckle heel surface, and the eccentricity of the reaction was insufficient to force the knuckle to its completely closed position so as to allow the lock to drop.

According to the present invention, a novel contour is provided on the coupler knuckle which overcomes the locking difficulties encountered heretofore.

This and other objects will be apparent from the following description and accompanying drawings wherein.

Figure 1:
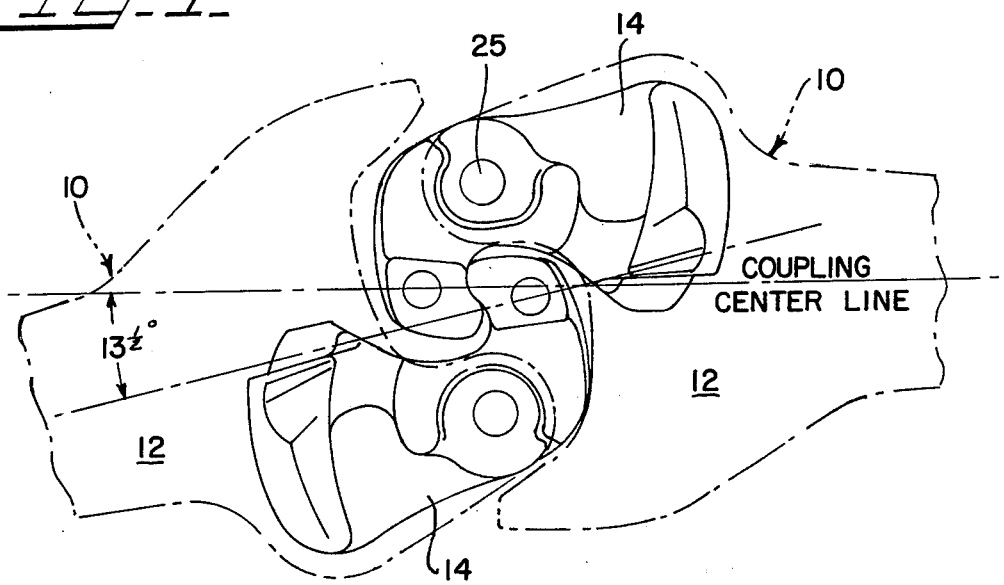
FIG. 1 is a top plan view of a pair of modified type E couplers as they would be coupled at maximum horizontal angling position.

Referring first to FIG. 1, each coupler 10 includes a head 12 and which is pivotally connected a knuckle 14. The couplers are shown in coupled positions with the respective coupler longitudinal axes being in maximum horizontal angling position. In E couplers, the maximum angle in a horizontal direction is 13°–30'.When couplers approach at an angle during a coupling operation, the force to move the closing knuckle to fully closed position so as to permit the coupler lock to drop is supplied by the reaction of the knuckle face bearing against the buffing face in the throat of the opposing knuckle. In prior art arrangements, it was possible for the closing knuckle to bind just short of complete closing. When this occurred, the lock could not drop to locked position to complete the coupling operation.

Figure 2:
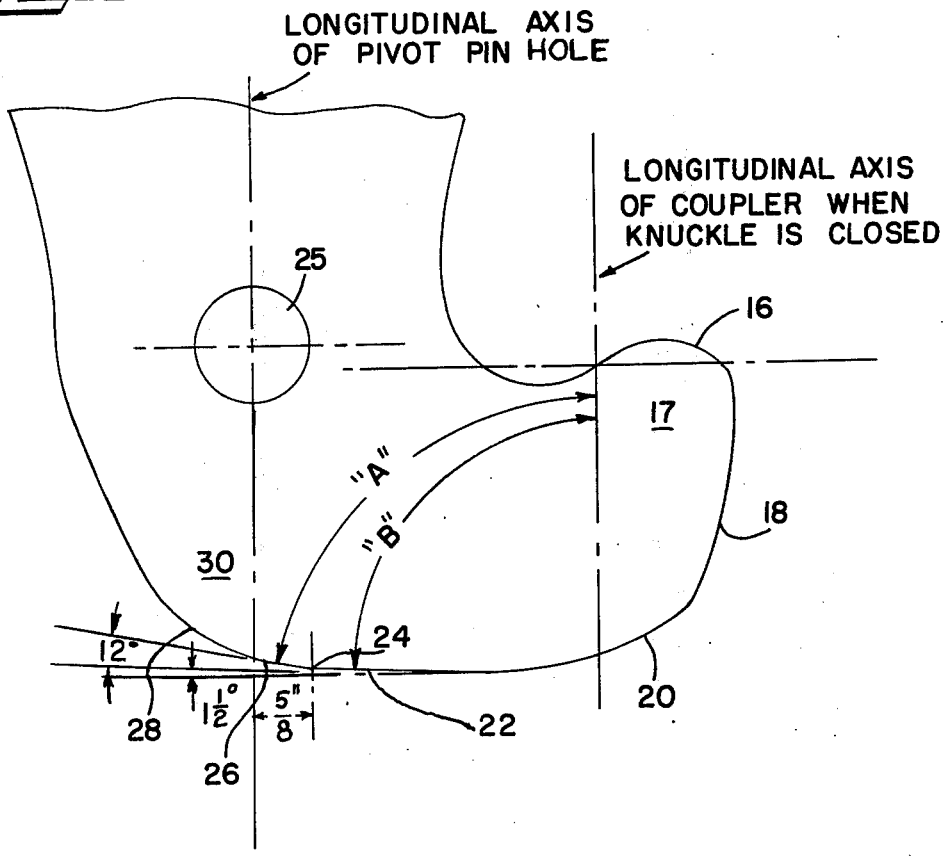
FIG. 2 is a fragmentary top plan view of a knuckle embodying the features of the present invention.

FIG. 2 illustrates a knuckle, modified according to the present invention, which effectively eliminates the above problem. The knuckle is shown oriented, relative to the longitudinal axis of the associated coupler, as it would be in normal closed position. The knuckle contour includes a pulling face 16 on nose 17 which merges into open-knuckle gathering face 18 and closed-knuckle gathering face 20. The gathering face 20 in turn merges into front face portion 22 which, under non-buffing conditions, slopes rearwardly at an angle of 1½° from perpendicular to the coupler axis. It should be pointed out that the front face of the knuckle becomes perpendicular to the coupler axis when the knuckle is forced under load to a completely closed position so that the knuckle face and the front buffing face of the opposing coupler are then in full face contact.

From a point 24 approximately ⅝ from the longitudinal axis of the pivot pin 25 in the direction of the coupler nose 17, front face surface 26 tapers rearwardly away from the front face surface 22 at an angle of about 12° until it merges with the curved surface 28 defining the knuckle heel 30. In other words, the angle A shown in FIG. 2 is 12° less than angle B. The distance of the line of intersection 24 of surfaces 22 and 26 from the pivot pin axis can vary to some extent from the preferred ⅝ inch and distances in the range of ½ inch to 1 inch have been found effective.

Figure 3:
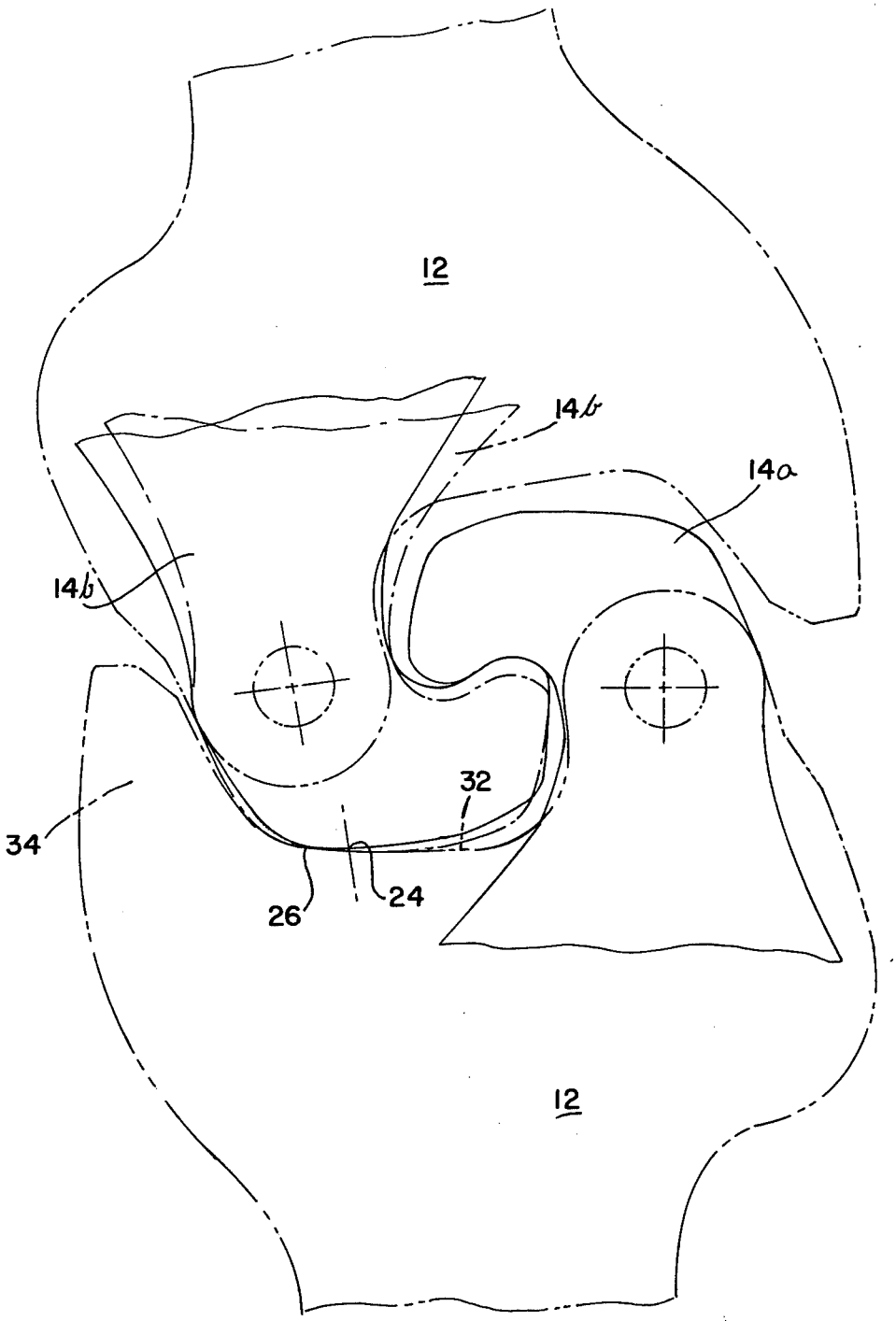
FIG. 3 is a fragmentary top plan view of a pair of horizontally angled couplers wherein a closing knuckle is shown in broken lines in almost-closed position and is shown in solid lines in completely closed positions.

FIG. 3 fragmentarily shows a par of improved knuckles positioned during the coupling of railway car couplers which are angled at an angle of 13 ½°, which is the maximum horizontal angling position of type E couplers. In this figure, knuckle **14*a* is shown in closed position while knuckle 14*b* is shown in broken lines in partially closed position, and is shown in solid lines in fully closed position. Also shown in FIG. 3 are the front buffing face 32 and guard arm 34 of the coupler head associated with closed knuckle 14*a*.**

When the knuckles of the illustrated angled couplers are partially coupled, the front buffing face 32 is contacted by closing knuckle **14*b* at line 24 representing the juncture of surfaces 22 and 26, which is far enough away from the pivot pin axis that sufficient turning moment is created to continue to pivot the knuckle to fully closed position. At fully closed position, shown in solid lines in FIG. 3, the 12° angled surface 26 comes into flat face engagement with buffing face 32.**

It is seen then, that knuckles formed to the novel contour are always subjected to a force moment sufficient to completely close the knuckle and allow the lock to drop into locked position.

What is claimed is:

1. In a coupling arrangement for opposed Type E railway car couplers which approach for coupling with the longitudinal axes thereof angularly related to each other at angles of from 0° to 13 ½°, each coupler having a head with a front buffing face and a knuckle pivoted to the head, the knuckle having a nose portion and a heel portion with a pivot pin hole therethrough, the improvement wherein each knuckle has a front face including a first flat surface extending transversely of the associated coupler when the knuckle is in closed position, and a second flat surface sloping rearwardly from said first surface at an angle of approximately 12° and merging wth the heel portion, said first and second surfaces intersecting at a point between the longitudinal axis of the associated coupler and a line parallel to that axis through the center of the pivot pin hole in the heel portion of the knuckle.

2. In a coupling arrangement according to claim 1, wherein said surfaces intersect at a point in the range of about ½ inch to 1 from said parallel line.

3. In a coupling arrangement according to claim 1, wherein said surfaces intersect at a point about ⅝ inch from said parallel line.

4. In a coupling arrangement wherein opposed railway car couplers may approach for coupling with their respective longitudinal axes angled relative to each other, and wherein one knuckle, which has a nose and a heel interconnected by a front face, is moved to closed position by the reaction between the front face thereof and a flat front buffer face of an opposing coupler head, the improvement wherein the front face of the knuckle includes a first flat surface which intersects a second flat surface sloping rearwardly therefrom and merging with the knuckle heel, the line of intersection of said flat surfaces being located so that, during a coupling operation, it contacts said flat front buffer face of the opposing coupler head and remains the sole area of contact up to full knuckle closing.

* * * * *